US010438722B2

(12) United States Patent
Maioli et al.

(10) Patent No.: US 10,438,722 B2
(45) Date of Patent: Oct. 8, 2019

(54) METHOD AND ARMOURED POWER CABLE FOR TRANSPORTING ALTERNATE CURRENT

(71) Applicant: PRYSMIAN S.P.A., Milan (IT)

(72) Inventors: Paolo Maioli, Milan (IT); Massimo Bechis, Milan (IT)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 14/903,647

(22) PCT Filed: Jul. 10, 2013

(86) PCT No.: PCT/EP2013/064550
§ 371 (c)(1),
(2) Date: Jan. 8, 2016

(87) PCT Pub. No.: WO2015/003745
PCT Pub. Date: Jan. 15, 2015

(65) Prior Publication Data

US 2016/0172077 A1 Jun. 16, 2016

(51) Int. Cl.
*H01B 7/26* (2006.01)
*H01B 7/04* (2006.01)
(Continued)

(52) U.S. Cl.
CPC ..... *H01B 7/26* (2013.01); *H01B 7/04* (2013.01); *H01B 9/025* (2013.01); *H01B 13/02* (2013.01); *H01B 7/14* (2013.01)

(58) Field of Classification Search
CPC ..... H01B 7/26
(Continued)

(56) References Cited

U.S. PATENT DOCUMENTS 2,980,755 A * 4/1961 Fairfield ..... H01B 9/0644 174/108
4,131,757 A * 12/1978 Felkel ..... H01B 7/04 138/130
(Continued)

FOREIGN PATENT DOCUMENTS

CN 101950619 1/2011
CN 202307273 7/2012
(Continued)

OTHER PUBLICATIONS

Dell'Anna, G. et al., "HV submarine cables for renewable offshore energy", cigré, Bologna 2011, pp. 241-247, www.cigre.org, (2011).
(Continued)

*Primary Examiner* — Stanley Tso
(74) *Attorney, Agent, or Firm* — Finnegan, Henderson, Farabow, Garrett & Dunner, L.L.P.

(57) ABSTRACT

A method and armored cable for transporting an alternate current at a maximum allowable working conductor temperature, as determined by the overall cable losses, the overall cable losses including conductor losses and armor losses. The cable includes at least one core, including an electric conductor having a cross section area, and an armor surrounding the core along a circumference. The method includes: causing the armor losses not higher than 40% of the overall cable losses by having the armor made with a layer of a plurality of metal wires having an elongated cross section with a major axis, the major axis being oriented tangentially with respect to the circumference; and transporting the alternate current at the maximum allowable working conductor temperature, in the electric conductor having cross section area sized on the overall cable losses including the armor losses not higher than 40% of the overall cable losses.

30 Claims, 5 Drawing Sheets

(51) Int. Cl.
*H01B 9/02* (2006.01)
*H01B 13/02* (2006.01)
*H01B 7/14* (2006.01)

(58) Field of Classification Search
USPC ..... 174/108
See application file for complete search history.

(56) References Cited

U.S. PATENT DOCUMENTS

| | | | | |
|---|---|---|---|---|
| 4,440,974 | A * | 4/1984 | Naudet | H01B 7/04 174/106 R |
| 7,381,900 | B2 | 6/2008 | Bremnes et al. | |
| 2009/0120663 | A1* | 5/2009 | Karlsen | H01B 7/14 174/113 R |
| 2012/0024565 | A1* | 2/2012 | Orini | H01B 7/14 174/106 R |
| 2012/0217000 | A1* | 8/2012 | Bremnes | F16L 53/007 166/57 |
| 2012/0221007 | A1* | 8/2012 | Batten | A61B 17/32056 606/80 |
| 2012/0234596 | A1* | 9/2012 | Lund | H01B 7/045 174/70 R |
| 2012/0298403 | A1* | 11/2012 | Johnson | D07B 1/02 174/130 |
| 2013/0308913 | A1* | 11/2013 | Tanigawa | G02B 6/02042 385/126 |
| 2014/0116564 | A1* | 5/2014 | McNab | G01L 1/242 138/137 |

FOREIGN PATENT DOCUMENTS

| | | |
|---|---|---|
| FR | 2 564 635 | 11/1985 |
| GB | 360996 | 11/1931 |
| GB | 885165 | 12/1961 |
| GB | 1051860 | 12/1966 |
| GB | 2 437 161 A | 10/2007 |

OTHER PUBLICATIONS

International Electrotechnical Commission, "Electric Cables—Calculation of the Current Rating", Part 1-1: Current rating equations (100% load factor) and calculation of losses—General, IEC: 60287-1-1, (2006), pp. 1-67.

Bremnes, J.J. et al., "Power loss and inductance of steel armoured multi-core cables: comparison of IEC values with "2,5D" FEA results and measurements", cigré, B1_116_2010, Cigre 2010, pp. 1-10, www.cigre.org, (2010).

Zaccone, E., Mechanical Aspects of Submarine Cable Armour, C11D Submarine Cables, Prysmian Powerlink, ICC Submarine cables, 16 pgs., 2012.

Brüggmann, J., "Wechselspannungstechnologiebasierte bipolare Mehrphansensysteme", http://duepublico.uni-duisburg-essen.de/serlets/DocumentServlet?id=30982, pp. 1-144, (2012).

Anonymous Third Party Observation filed in PCT/EP2013/064550 on Nov. 9, 2015.

International Search Report from the European Patent Office for International Application No. PCT/EP2013/064550, dated Feb. 24, 2014.

Written Opinion of the International Searching Authority from the European Patent Office for International Application No. PCT/EP2013/064550, dated Feb. 24, 2014.

Notification of the First Office Action dated Oct. 17, 2016, from the Patent Office of the People's Republic of China in counterpart Chinese Patent Application No. 201380078092.9.

Examination Report from the European Patent Office, in counterpart European Application No. 13 739 632.1 dated Oct. 13, 2017.

* cited by examiner

METHOD AND ARMOURED POWER CABLE FOR TRANSPORTING ALTERNATE CURRENT

CROSS REFERENCE TO RELATED APPLICATION

This application is a national phase application based on PCT/EP2013/064550, filed Jul. 10, 2013, the content of which is incorporated herein by reference.

BACKGROUND OF THE INVENTION

Field of the Invention

The present invention relates to a method and an armoured power cable for transporting alternate current.

Description of the Related Art

An armoured power cable is generally employed in application where mechanical stresses are envisaged. In an armoured power cable, the cable core or cores (typically three stranded cores in the latter case) are surrounded by at least one metal layer in form of wires for strengthening the cable structure while maintaining a suitable flexibility.

When alternate current (AC) is transported into a cable, the temperature of electric conductors within the cable rises due to resistive losses, a phenomenon referred to as Joule effect.

The transported current and the electric conductors are typically sized in order to guarantee that the maximum temperature in electric conductors is maintained below a prefixed threshold (e.g., below 90° C.) that guarantees the integrity of the cable.

The international standard IEC 60287-1-1 (second edition 2006-12) provides methods for calculating permissible current rating of cables from details of permissible temperature rise, conductor resistance, losses and thermal resistivities. In particular, the calculation of the current rating in electric cables is applicable to the conditions of the steady-state operation at all alternating voltages. The term "steady state" is intended to mean a continuous constant current (100% load factor) just sufficient to produce asymptotically the maximum conductor temperature, the surrounding ambient conditions being assumed constant. Formulae for the calculation of losses are also given.

In IEC 60287-1-1, the permissible current rating of an AC cable is derived from the expression for the permissible conductor temperature rise $\Delta\theta$ above ambient temperature Ta, wherein $\Delta\theta = T - Ta$, T being the conductor temperature when a current I is flowing into the conductor and Ta being the temperature of the surrounding medium under normal conditions, at a situation in which cables are installed, or are to be installed, including the effect of any local source of heat, but not the increase of temperature in the immediate neighborhood of the cables to heat arising therefrom. For example, the conductor temperature T should be kept lower than about 90° C.

For example, according to IEC 60287-1-1, in case of buried AC cables where drying out of the soil does not occur or AC cables in air, the permissible current rating can be derived from the expression for the temperature rise above ambient temperature:

$$I = \left[\frac{\Delta\theta - W_d \cdot [0.5 \cdot T_1 + n \cdot (T_2 + T_3 + T_4)]}{R \cdot T_1 + n \cdot R \cdot (1 + \lambda_1) \cdot T_2 + n \cdot R \cdot (1 + \lambda_1 + \lambda_2) \cdot (T_3 + T_4)}\right]^{0.5} \quad (1)$$

where:

I is the current flowing in one conductor (Ampere)

$\Delta\theta$ is the conductor temperature rise above the ambient temperature (Kelvin)

R is the alternating current resistance per unit length of the conductor at maximum operating temperature (Ω/m);

$W_d$ is the dielectric loss per unit length for the insulation surrounding the conductor (W/m);

$T_1$ is the thermal resistance per unit length between one conductor and the sheath (K·m/W);

$T_2$ is the thermal resistance per unit length of the bedding between sheath and armour (K·m/W);

$T_3$ is the thermal resistance per unit length of the external serving of the cable (K·m/W);

$T_4$ is the thermal resistance per unit length between the cable surface and the surrounding medium (K·m/W);

n is the number of load-carrying conductors in the cable (conductors of equal size and carrying the same load);

$\lambda_1$ is the ratio of losses in the metal sheath to total losses in all conductors in that cable;

$\lambda_2$ is the ratio of losses in the armouring to total losses in all conductors in the cable.

In case of three-core cables and steel wire armour, the ratio $\lambda_2$ is given, in IEC 60287-1-1, by the following formula:

$$\lambda_2 = 1.23\frac{R_A}{R}\left(\frac{2c}{d_A}\right)^2 \frac{1}{\left(\frac{2.77 R_A 10^6}{\omega}\right)^2 + 1} \quad (2)$$

where $R_A$ is the AC resistance of armour at maximum armour temperature (Ω/m);

R is the alternating current resistance per unit length of conductor at maximum operating temperature (Ω/m);

$d_A$ is the mean diameter of armour (mm);

c is the distance between the axis of a conductor and the cable centre (mm);

ω is the angular frequency of the current in the conductors.

SUMMARY OF THE INVENTION

The Applicant observes that, in general, the reduction of losses means reduction of the cross-section of the conductor/s and/or an increase of the permissible current rating.

In case of an armoured AC cable, the contribution of the armour losses to the overall cable losses has been investigated.

J. J. Bremnes et al. ("Power loss and inductance of steel armoured multi-core cables: comparison of IEC values with "2.5 D" FEA results and measurements", Cigré, Paris, B1-116-2010) analyze armour losses in a three-core cable. They state that, for balanced three-phase currents, the collective armour will not allow any induced current flow in the armour wires due to cancellation by stranding/twisting. Any exception to this will require that the armour wires have exactly the same pitch as the cores, that the cable is very short, or that all armour wires are continuously touching both neighbouring wires. The authors state that this is in sharp contrast to the formulae for multi-core armour loss given in IEC 60287-1-1, in which the armour resistance $R_A$ is an important parameter. The authors state that, typically, for a three-core submarine cable, the IEC formula will assign 20-30% power loss to a collective steel armour, while their 2.5 D finite element models and full scale measurements both predict insignificant power loss in the armour.

G. Dell'Anna et al. ("HV submarine cables for renewable offshore energy", Cigré, Bologna, 0241-2011) state that AC magnetic field induces losses in the armour and that hysteresis and eddy current are responsible for the losses generated into the armour. The authors show experimental results obtained by measuring the losses on a 12.3 m long cable, with a copper conductor of 800 $mm^2$, and an outer diameter of 205 mm. The measurements were made for a current ranging from 20 A to 1600 A. FIG. 4 shows the measured values of the phase resistance, in two conditions with lead sheaths short circuited and armour present or completely removed. The phase resistance (that is the cable losses) is constant with the current in absence of armour, while it increases with current in presence of the armour. The authors state that the numerical value of the losses is important, especially for large conductor cables, but it is not as high as reported in IEC 60287-1-1 formulae.

The Applicant notes that Bremnes et al. state that power losses in the armour are insignificant. However, they use 2.5 D finite element models and perform the loss measures with 8.5 km and 12 km long cables with a very low test current of 51 A and conductors of 500 and 300 $mm^2$. The Applicant observes that a test current of 51 A cannot be significant for said conductor size transporting, typically, standard current values higher than 500 A.

On the other hand, Dell'Anna et al. state that the losses generated into the armour are due to hysteresis and eddy current, they increase with current in presence of the armour and their numerical value is important, especially for large conductor cables, but not as high as reported in IEC 60287-1-1 formula.

In view of the contradictory teaching in the prior art documents, the Applicant further investigated the armour losses in an armoured AC electric cable.

During investigation, the Applicant took into consideration the cross-section shape of the armour wires. As it will be shown later in the description with reference to Table 1 and FIG. 5, the Applicant measured the losses in single wires having substantially the same thickness Dw and differing in the cross-section shape. In particular, the losses generated by a single wire with elongated cross-section were compared with that of a single wire with round or square cross-section, and the first were found higher than the latter.

However, when the Applicant measured the losses of an armour made of wires with elongated cross-section and the losses of an armour made of wires with round or square cross-section—both armours having substantially the same cross-section area—it has been surprisingly found that the first are lower than the latter. In particular, the Applicant observed that the armour losses are reduced when the armour wires have an elongated cross section with the major axis oriented tangentially with respect to the cable circumference.

The Applicant thus found that, by using an armoured AC cable comprising an armour layer wherein the armour wires have an elongated cross section with a major axis oriented tangentially with respect to the cable circumference, the armour losses are reduced. This enables to improve the performances of the armoured AC cable in terms of transmitted current and/or cable conductor cross-section area S. Indeed, it is possible to comply with IEC 60287-1-1 requirements for permissible current rating by transmitting into the cable conductor an increased current value and/or by using cable conductors with a reduced value of the cross-section area S (the AC resistance per unit length R in the above formula (1) being proportional to $\rho/S$, wherein $\rho$ is the conductor material electrical resistivity).

In a first aspect the present invention thus relates to a method of transporting an alternate current I at a maximum allowable working conductor temperature T, as determined by the overall cable losses, said overall cable losses including conductor losses and armour losses, by a power cable comprising at least one core comprising an electric conductor having a cross section area S, and an armour surrounding said core along a circumference, the method comprising:

causing the armour losses being not higher than 40% of the overall cable losses by having said armour made with a layer of a plurality of metal wires having an elongated cross section with major axis A', said major axis A' being oriented tangentially with respect to the circumference; and transporting said alternate current I, at said maximum allowable working conductor temperature T, in the electric conductor having cross section area S sized on said overall cable losses including said armour losses not higher than 40% of the overall cable losses.

In a second aspect the present invention relates to a power cable for transporting an alternate current I comprising at least one core comprising an electric conductor, and an armour surrounding the at least one core along a circumference, in which each electric conductor has a cross section area S sized for operating the cable to transport said alternate current I at a maximum allowable working conductor temperature T, as determined by overall cable losses including armour losses, wherein:

the armour comprises a plurality of metal wires with an elongated cross section, said plurality of metal wires being arranged with major axis oriented tangentially with respect to the circumference, and the cross section area S of the electric conductor for transporting said alternate current I is sized by reckoning armour losses not higher than 40% of the overall cable losses.

In the present description and claims, the term "core" is used to indicate an electric conductor surrounded by at least one insulating layer and, optionally, at least one semiconducting layer. Optionally, said core further comprises a metal screen.

In the present description and claims, all indications of directions and the like, such as "axial", "radial" and "tangential" are made with reference to the longitudinal axis of the cable.

In particular, "axial" is used to indicate a direction parallel to the longitudinal axis of the cable; "radial" is used to indicate a direction intersecting the longitudinal axis of the cable and laying in a plane perpendicular to said longitudinal axis; and "tangential" is used to indicate a direction perpendicular to the "radial" direction and laying in a plane perpendicular to the longitudinal axis of the cable.

In the present description and claims, the term "elongated cross section" is used to indicate the shape of the transversal cross section perpendicular to the longitudinal axis of the armour wire, said shape being oblong, elongated in one dimension.

In the present description and claims, the term "unilay" is used to indicate that the winding of the wires of a cable layer (in the case, the armour) around the cable and the stranding of the cores have a same direction, with a same or different pitch.

In the present description and claims, the term "contralay" is used to indicate that the winding of the wires of a cable layer (in the case, the armour) around the cable and the stranding of the cores have an opposite direction, with a same or different pitch.

In the present description and claims, the term "maximum allowable working conductor temperature" is used to indicate the highest temperature a conductor is allowed to reach in operation in a steady state condition, in order to guarantee integrity of the cable. The working conductor temperature substantially depends on the overall cable losses, including conductor losses due to the Joule effect and other additional dissipative phenomena.

The armour losses are another significant component of the overall cable losses.

In the present description and claims, the term "permissible current rating" is used to indicate the maximum current that can be transported in an electric conductor in order to guarantee that the electric conductor temperature does not exceed the maximum allowable working conductor temperature in steady state condition. Steady state is reached when the rate of heat generation in the cable is equal to the rate of heat dissipation from the surface of the cable, according to laying conditions.

In the present description and claims the term "ferromagnetic" indicates a material, e.g. steel, that below a given temperature has a relative magnetic permeability significantly greater than 1.

In the present description and claims, the term "crossing pitch C" is used to indicate the length of cable taken by the wires of the armour to make a single complete turn around the cable cores. The crossing pitch C is given by the following relationship:

$$C = \left| \frac{1}{\frac{1}{A} - \frac{1}{B}} \right|$$

wherein A is the core stranding pitch and B is the armour winding pitch. A is positive when the cores stranded together turn right (right screw) and B is positive when the armour wires wound around the cable turn right (right screw). The value of C is always positive. When the values of A and B are very similar (both in modulus and sign) the value of C becomes very large.

According to the invention, the performances of the power cable can be improved in terms of increased transported alternate current with respect to a cable having substantially the same electric conductor cross section area S and overall area of armour cross section with non-elongated armour wires; or in terms reduced electric conductor cross section area S with respect to a cable transporting substantially the same amount of alternate current and having substantially the same overall area of armour cross section with non-elongated armour wires. A combination of these two alternatives can also be envisaged.

In the cable market, a cable is offered for sale or sold accompanied by indication relating to, inter alia, the amount of transported alternate current, the cross section area S of the electric conductor/s and the maximum allowable working conductor temperature. With respect to a known cable, a cable according to the invention will bring indication of a reduced cross section area of the electric conductor/s with substantially the same amount of transported alternate current and maximum allowable working conductor temperature, or an increased amount of transported alternate current with substantially the same cross section area of the electric conductor/s and maximum allowable working conductor temperature.

This is very advantageous because it enables to make a cable more powerful and/or to reduce the size of the conductors with consequent reduction of cable size, weight and cost.

The alternate current I caused to flow into the cable and the cross section area S advantageously comply with permissible current rating requirements according to IEC Standard 60287-1-1, by reckoning armour losses equal to or lower than 40% of the overall cable losses.

The armour losses can be equal to or lower than 20% of the overall cable losses. By a proper selection of the armour construction according to the teaching of the invention, the armour losses can be equal to or lower than 10% of the overall cable losses and can even amount down to 3% of the overall cable losses.

By a proper selection of the armour construction according to the teaching of the invention, the armour losses $\lambda_{2'}$ can be significantly lower than those $\lambda_2$ calculated by international standard IEC 60287-1-1, second edition 2006-12. In particular, and advantageously, $\lambda_{2'} \leq 0.75\lambda_2$. Preferably, $\lambda_{2'} \leq 0.50\lambda_2$. More preferably, $\lambda_{2'} \leq 0.25\lambda_2$. Even more preferably, $\lambda_{2'} \leq 0.10\lambda_2$.

According to the present invention, a method is provided for transporting alternate current at a maximum allowable working conductor temperature T (as determined by overall cable losses comprising armour losses) in a power cable comprising at least one core comprising, in turn, an electric conductor having a cross section area S, and an armour surrounding the at least one core. The armour losses are reduced by building the cable armour with a layer of a plurality of metal wires having an elongated cross section, and by arranging the metal wires with major axis oriented tangentially with respect to a cable circumference. The so reduced armour losses allow to increase the value of said alternate current transported at said maximum allowable working conductor temperature T (as determined by overall cable losses comprising the reduced armour losses) or to reduce the value of the cross section area S of each electric conductor for transporting the alternate current at said maximum allowable working conductor temperature T (as determined by overall cable losses comprising the reduced armour losses). Said increasing step and reduction step can be concurrently performed.

The present invention in at least one of the aforementioned aspects can have at least one of the following preferred characteristics.

Preferably, the armour metal wires have elongated cross-section with a ratio between major axis length and minor axis length at least equal to 1.5, more preferably at least equal to 2. Advantageously, said ratio is not higher than 5 because armour wires with elongated cross-section having a too long major axis could give place to manufacturing problem during the step of winding the armour around the cable.

Advantageously, the elongated cross section of the armour wires has smoothed edges. Besides being preferable from a manufacturing point of view, armour wires with smoothed edges avoid damages to the underlying cable layers and the risk of occurrence of electric field peaks.

Preferably, the edges of the armour wires are smoothed with a radius of curvature $\beta \times Dw$, wherein Dw is the wire thickness along the minor axis of the elongated cross section and $\beta$ is of from 0.1 to 0.5, more preferably of from 0.2 to 0.4. A value of β outside the preferred ranges can give place to an increase of the armour losses.

The elongated cross section of the armour wires can have a substantially rectangular shape.

Alternatively, the elongated cross section is substantially shaped as an annulus portion. This shape provides advantage in term of armour construction stability when the radius of the cable is substantial.

In a further embodiment, the elongated cross section is provided with a notch and a protrusion at the two opposing ends along the major axis, so as to improve shape matching of adjacent wires. The notch/protrusion interlocking among wires makes the armour advantageously firm even in case of dynamic cable.

Preferably, the elongated cross section of the armour wires have a minor axis from about 1 mm to about 7 mm long, more preferably, from 2 mm to 5 mm long.

Preferably, the elongated cross section of the armour wires have a major axis from 3 mm to 20 mm long, more preferably from 4 mm to 10 mm long.

Preferably, the cable of the invention comprises at least two cores stranded together according to a core stranding lay and a core stranding pitch A.

Preferably, the metal wires of the armour are wound around the at least two cores according to a helical armour winding lay and an armour winding pitch B.

Advantageously, the helical armour winding lay has the same direction as the core stranding lay and the armour winding pitch B is of from 0.4 A to 2.5 A and differs from A by at least 10%.

Preferably, pitch B≥0.5 A. More preferably, pitch B≥0.6 A. Preferably, pitch B≤2 A. More preferably, pitch B≤1.8 A.

Advantageously, the core stranding pitch A, in modulus, is of from 1000 to 3000 mm. Preferably, the core stranding pitch A, in modulus, is of from 1500 mm. Preferably, the core stranding pitch A, in modulus, is not higher than 2600 mm.

Preferably crossing pitch C≥A. More preferably, C≥5 A. Even more preferably, C≥10 A. Suitably, C can be up to 12 A.

Suitably, when the cable of the invention comprises two or more cores, the armour surrounds all of the said cores together, as a whole.

The armour of the cable of the invention can comprises an outer layer of a plurality of metal wires, surrounding said (inner) layer of a plurality of metal wires.

The metal wires of the outer armour layer are suitably wound around the cores according to an outer layer winding lay and an outer layer winding pitch B'. Preferably, the outer layer winding lay is helicoidal.

Preferably, the outer layer winding lay has an opposite direction with respect to the core stranding lay (that is, the outer layer winding lay is contralay with respect to the core stranding lay and with respect to the armour winding lay). This contralay configuration of the outer layer is advantageous in terms of mechanical performances of the cable.

Preferably, the outer layer winding pitch B' is higher, in absolute value, of the armour winding pitch B. More preferably, the outer layer winding pitch B' is higher, in absolute value, of B by at least 10% of B.

Preferably, the metal wires of the outer layer of the armour have substantially the same cross section in shape and, optionally, in size as those of the layer radially internal thereto.

The wires of the armour can be made of ferromagnetic material. For example, they are made of construction steel, ferritic stainless steel or carbon steel.

Alternatively, the wires of the armour can be mixed ferromagnetic and non-ferromagnetic. For example, in the layer of wires, ferromagnetic wires can alternate with non-ferromagnetic wires.

Preferably, when the cable of the invention comprises two or more cores, each of them is a single phase core. Advantageously, the at least two cores are multi-phase cores.

Typically, the cable comprises three cores. In AC systems, the cable advantageously is a three-phase cable. The three-phase cable advantageously comprises three single phase cores.

The AC cable can be a low, medium or high voltage cable (LV, MV, HV, respectively). The term low voltage is used to indicate voltages lower than 1 kV. The term medium voltage is used to indicate voltages of from 1 to 35 kV. The term high voltage is used to indicate voltages higher than 35 kV.

The AC cable may be terrestrial or underwater. The terrestrial cable can be at least in part buried or positioned in tunnels.

BRIEF DESCRIPTION OF THE DRAWINGS

The features and advantages of the present invention will be made apparent by the following detailed description of some exemplary embodiments thereof, provided merely by way of non-limiting examples, description that will be conducted by making reference to the attached drawings, wherein.

DETAILED DESCRIPTION OF THE INVENTION

Figure 1:
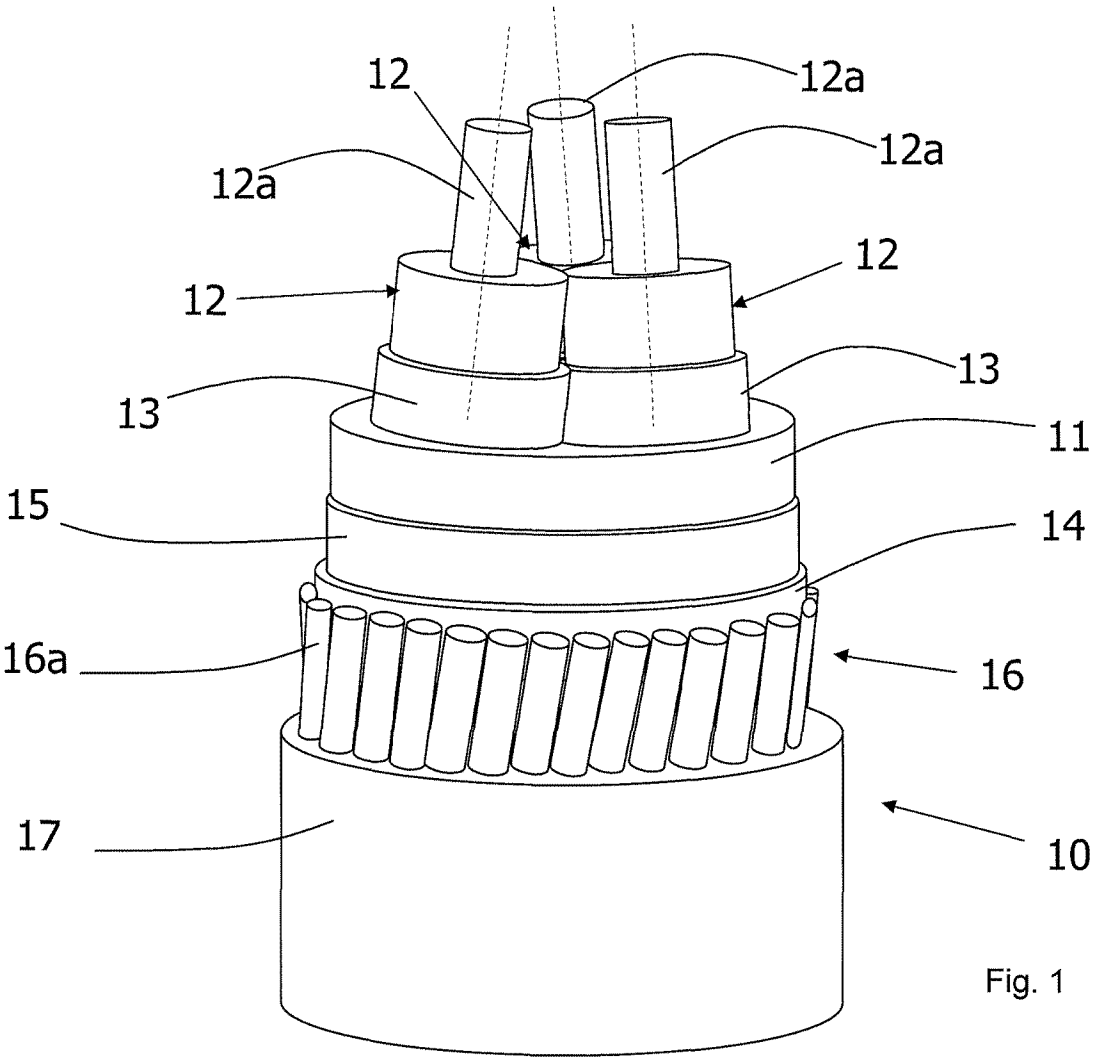
FIG. 1 schematically shows an exemplary power cable according to an embodiment of the invention.

FIG. 1 schematically shows an exemplarily armoured AC power cable 10 for underwater application comprising three cores 12. Each core comprises a metal electric conductor 12*a* typically made of copper, aluminium or both, in form of a rod or of stranded wires. The conductor 12*a* is sequentially surrounded by an inner semiconducting layer and insulation layer and an outer semiconducting layer, said three layers (not shown) being made of polymeric material (for example, polyethylene), wrapped paper or paper/polypropylene laminate. In the case of the semiconducting layer/s, the material thereof is charged with conductive filler such as carbon black.

The three cores 12 are helically stranded together according to a core stranding pitch A. The three cores are each enveloped by a metal sheath 13 (for example, made of lead) and embedded in a polymeric filler 11 surrounded, in turn, by a tape 15 and by a cushioning layer 14. Around the cushioning layer 14 an armour 16 comprising a layer of wires 16*a* is provided. The wires 16*a* are helically wound around the cushioning layer 14 according to an armour winding pitch B. The armour 16 is surrounded by a protective sheath 17.

Each conductor 12*a* has a cross section area S, wherein $S=\pi(d/2)^2$, d being the conductor diameter.

The wires 16*a* are metallic and are preferably made of a ferromagnetic material such as carbon steel, construction steel, ferritic stainless steel.

In armour 16, the number of ferromagnetic wires 16*b* is preferably reduced with respect to a situation wherein the armour ferromagnetic wires cover all the external perimeter of the cable 10.

Number of wires in an armour layer can be, for example, computed as the number of wires that fill-in the perimeter of the cable and a void of about 5% of a wire diameter is left between two adjacent wires.

In order to reduce the number of ferromagnetic wires 16*b*, the armour 16 can advantageously comprise ferromagnetic wires 16*b* alternating with non-ferromagnetic wires 16*c* (e.g., plastic or stainless steel).

According to the invention, the wires 16*a* have an elongated cross section with a major axis oriented tangentially with respect to the cable 10.

Figure 2A:
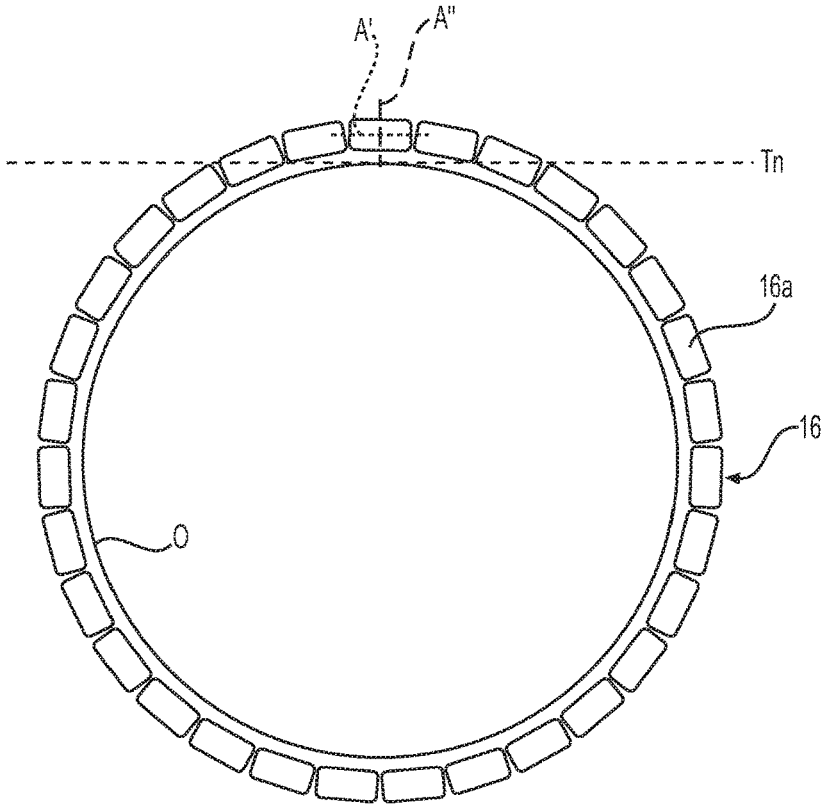
FIGS. 2-4 schematically show three examples of elongated cross sections of armour metal wires that can be used in the cable of FIG. 1.
Figure 2B:
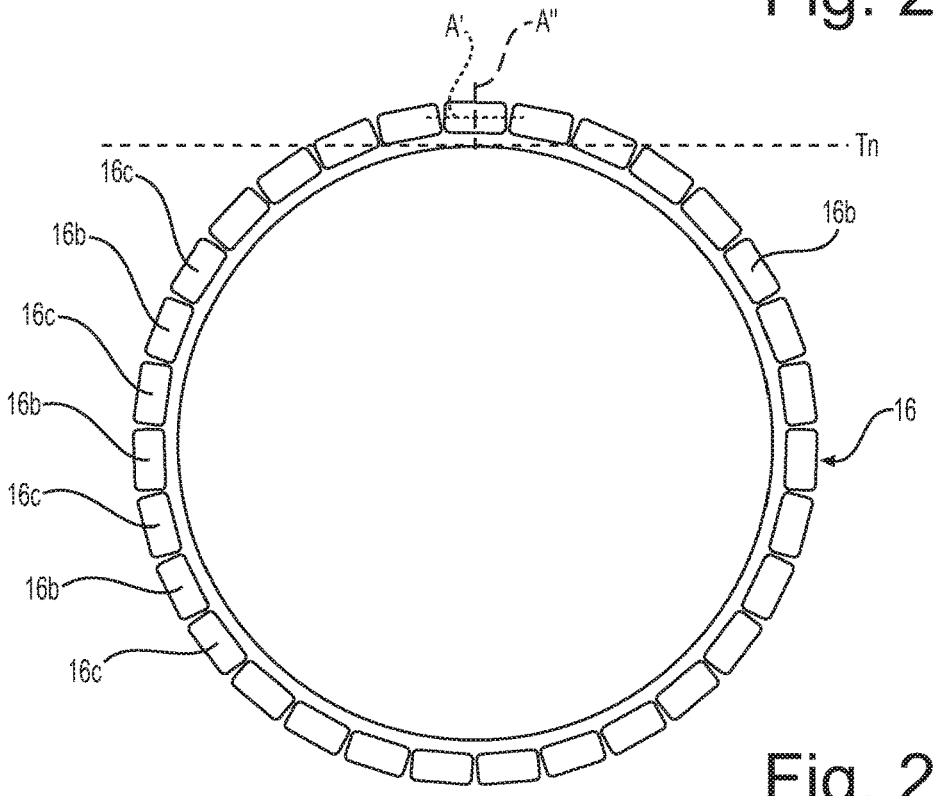
Figure 3:
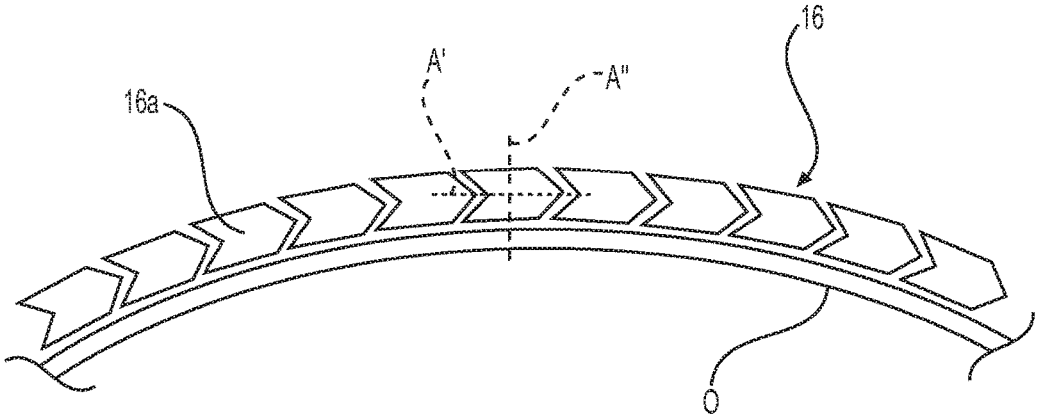
Figure 4:
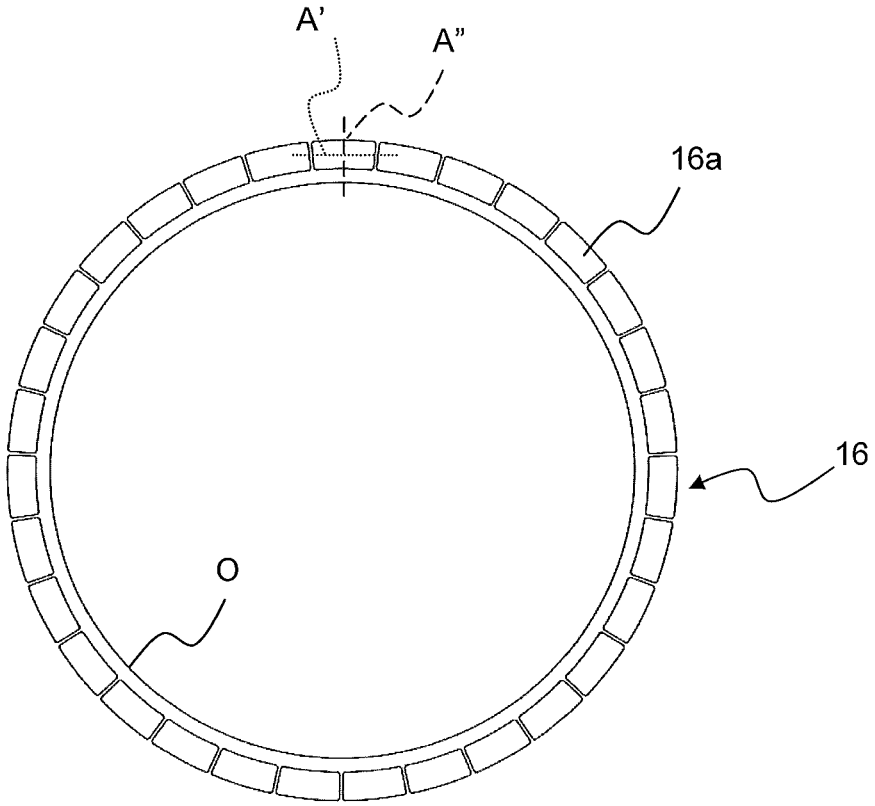

FIGS. 2-4 schematically show four examples of armour 16 made of wires 16*a* with different elongated cross sections suitable for the present invention. The cross-section areas of the three examples can be different from one another. The major axis of the wire cross section is indicated with A' and the minor axis with A".

For the sake of clarity, in these figures only the wires 16*a* surrounding a circumference O, enclosing the core/s 12 of the cable 10, are shown.

In the embodiment of FIG. 2*a* the elongated cross section of the wires 16*a* has a substantially rectangular shape, with smoothed angles.

In the embodiment of FIG. 2*b*, the wires of the armour 16 are mixed ferromagnetic wires 16*b* and non-ferromagnetic wires 16*c*.

In the embodiment of FIG. 3, where only a portion of the armour 16 is shown, the elongated cross section has a notch and a protrusion at the two opposing ends along major axis A', so as to improve shape matching of adjacent wires 16*a*.

In the embodiment of FIG. 4 the elongated cross section is substantially a circumferential portion of an annulus, with smoothed angles.

As shown in FIG. 2*a*, the major axis A' of the elongated cross section of the wires 16*a* is oriented according to a tangential direction Tn of the circumference O.

During development activities performed in order to investigate the armour losses in an AC electric power cable, the Applicant tested an AC three-phase power cable having: three cores stranded together according to a core pitch A of 1442 mm; an electric conductor cross section area S of 500 $mm^2$; an AC current in each conductor of 800 A; a frequency of 50 Hz; phase to phase voltage of 18/30 KV; armour wires having an electrical resistivity $\rho$ of $20.8*10^{-8}$ ohm*m, and relative magnetic permeability $\mu_r=|\mu_r|\bullet e^{-i\varphi}$ with $|\mu_r|=300$ and $\phi=60°$.

In a first investigation performed on a model based on said cable, the Applicant computed, by using a 3D model, the losses generated in a single straight armour wire having circular, square or rectangular cross section with smoothed edges, with different sizes.

Figure 5:
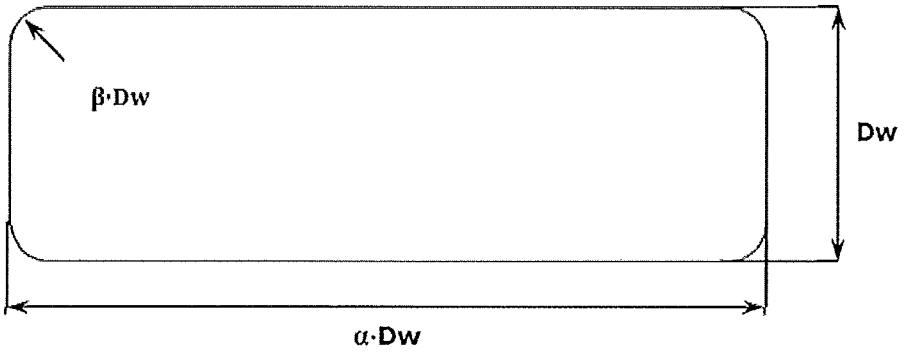
FIG. 5 schematically shows the meaning of symbols Dw, α and β.

The results of the computations are shown in Table 1 below. The meaning of symbols Dw, $\beta$ and $\alpha$ in case of square and rectangular cross section with smoothed edges is schematically shown in FIG. 5. In case of circular cross section, Dw is the wire diameter. The wire total losses indicate both resistive and hysteretic losses.

TABLE 1

| Wire cross section shape and size | $\alpha$ | wire cross section area ($mm^2$) | wire total losses (W/m) |
|---|---|---|---|
| circular Dw = 5 mm | 1 | 19.6 | 0.272 |
| circular Dw = 5.5 mm | 1 | 23.8 | 0.309 |
| square Dw = 5 mm; $\beta$ = 0.15 | 1 | 25.0 | 0.327 |
| Rectangular Dw = 5 mm; $\beta$ = 0.15 | 2 | 50.0 | 0.548 |
| Rectangular Dw = 5 mm; $\beta$ = 0.15 | 3 | 75.0 | 0.744 |
| Rectangular Dw = 5 mm; $\beta$ = 0.15 | 4 | 100.0 | 0.919 |

In case of a single straight armour wire, substantially parallel to the cable longitudinal axis, the armour wire having a circular or square cross section generally provides lower losses with respect to a wire having a rectangular cross section. In the single wires having rectangular cross-section, the losses increase proportionally to the ratio major axis/minor axis $\alpha$.

In a further investigation performed on the same model as above, the Applicant computed, by using a 3D model, the armour losses generated in a layer of armour formed by straight wires having circular, square or rectangular cross section with smoothed edges and different sizes, the overall area of the armour cross section being substantially the same.

The results of the computations are shown in table 2 below.

TABLE 2

| Wire cross section shape and size | $\alpha$ | number of wires | overall area of armour cross section ($mm^2$) | armour total losses (W/m) |
|---|---|---|---|---|
| circular Dw = 4.8 mm | 1 | 66 | 1194.3 | 8.78 |
| circular Dw = 5 mm | 1 | 61 | 1197.7 | 9.11 |
| circular Dw = 5.5 mm | 1 | 50 | 1187.9 | 9.41 |
| square Dw = 5 mm; $\beta$ = 0.15 | 1 | 48 | 1200.0 | 9.56 |
| Rectangular Dw = 5 mm; $\beta$ = 0.15 | 2 | 24 | 1200.0 | 8.64 |
| Rectangular Dw = 5 mm; $\beta$ = 0.15 | 3 | 16 | 1200.0 | 8.12 |
| Rectangular Dw = 5 mm; $\beta$ = 0.15 | 4 | 12 | 1200.0 | 7.75 |

In case of armour with a plurality of straight armour wires, substantially parallel to the cable longitudinal axis, the losses have a behaviour which is just the opposite of the behaviour shown in Table 1. Indeed, in the present test the armours having wires with rectangular cross section have losses much lower than the armours having wires with circular or square cross section. In particular, the armour losses decrease by increasing the ratio major axis/minor axis $\alpha$. The Applicant also measured the losses in an armour made of a metallic tube having a cross-section area of 1200.0 $mm^2$. The losses of this tube amounted to 11.44 W/m, considerably greater than any other armour configuration tested in Table 2.

Taking into account the above formula (1) provided by IEC 60287-1-1, the armour losses reduction due to the use of elongated cross section wires enables to increase the permissible current rating of a cable. The rise of permissible current rating leads to two improvements in an AC transport system: increasing the current transported by a power cable and/or providing a power cable with a reduced electric conductor cross section area S, the increase/reduction being considered with respect to the case wherein the armour losses are instead computed with wires having not elongated cross section, the overall area of the armour cross section being substantially the same.

This is very advantageous because it enables to make a cable more powerful and/or to reduce the size of the electric conductors with consequent reduction of cable size, weight and cost.

Without the aim of being bound to any theory, the Applicant believes that his finding (that the armour losses are highly reduced when the armour wires have an elongated cross section with the major axis oriented tangentially with respect to the cable) is due to the fact that the use of armour wires having an elongated cross section enables to reduce the wire surface facing the magnetic field generated by the AC current transported by the cable conductors with respect to the volume of magnetic material of the wires, thereby reducing the eddy currents induced into the armour wires.

It is observed that the above investigations have been performed by considering straight armour wires, in order to investigate the effects of wire cross section on the armour losses independently from any other effect on the armour losses due, for example, to wire winding.

However, in the cable 10 the wires 16*a* are advantageously helically wound according to an armour winding pitch B.

During the development activities performed by the Applicant in order to investigate the armour losses in an AC electric cable, the Applicant further found that the armour losses highly change depending on the fact that the armour winding pitch B is unilay or contralay to the core stranding pitch A. In particular, the armour losses are highly reduced when the armour winding pitch B is unilay to the core stranding pitch A, compared with the situation wherein the armour winding pitch B is contralay to the core stranding pitch A.

Figure 6:
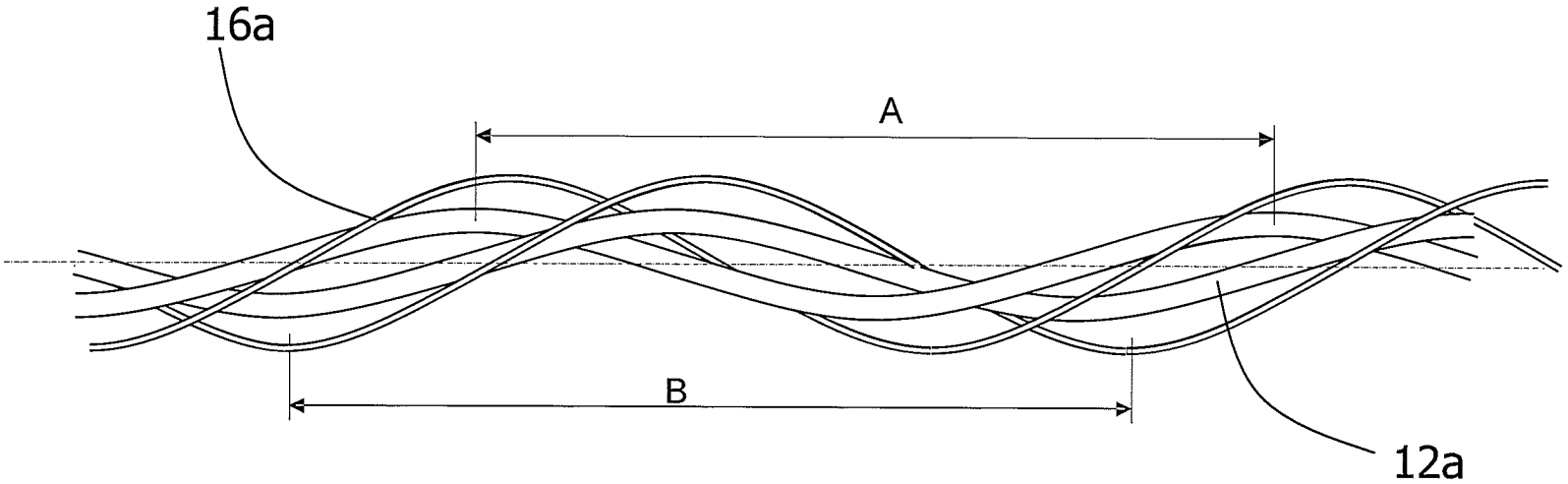
FIG. 6 schematically illustrates stranded cores and wound armour wires, respectively with core stranding pitch A and armour winding pitch B, of a power cable according to an embodiment of the invention.

In a preferred embodiment of the invention, in order to further reduce the armour losses, the helical armour winding lay has thus the same direction as the core stranding lay, as schematically shown in FIG. 6.

Advantageously, the armour winding pitch B is higher than 0.4 A. Preferably, B≥0.5 A. More preferably, B≥0.6 A. Advantageously, the armour winding pitch B is smaller than 2.5 A. More preferably, the armour winding pitch B is smaller than 2 A. Even more preferably, the armour winding pitch B is smaller than 1.8 A.

Advantageously, the armour winding pitch B is different from the core stranding pitch A (B≠A). Such a difference is at least equal to 10% of pitch A. Though seemingly favourable in term of armouring loss reduction, the configuration with B=A would be disadvantageous in terms of mechanical strength.

Advantageously, the core stranding pitch A, in modulus, is of from 1000 to 3000 mm. More advantageously, the core stranding pitch A, in modulus, is of from 1500 to 2600 mm. Low values of A are economically disadvantageous as higher conductor length is necessary for a given cable length. On the other side, high values of A are disadvantageous in term of cable flexibility.

Advantageously, crossing pitch C is preferably higher than the core stranding pitch A, in modulus. More preferably, C≥3 A, in modulus. Even more preferably, C≥10 A, in modulus.

Without the aim of being bound to any theory, the Applicant believes that this further finding (that the armour losses are highly reduced when B is unilay to A) is due to the fact that when A and B are of the same sign (same direction) and, in particular, when A and B are equal or very similar to each other, the cores and the armour wires are parallel or nearly parallel to each other. This means that the magnetic field generated by the AC current transported by the conductors in the cores is perpendicular or nearly perpendicular to the armour wires. This cause the eddy currents induced into the armour wires to be parallel or nearly parallel to the armour wires longitudinal axis.

On the other hand, when A and B are of opposite sign (contralay), the cores and the armour wires are perpendicular or nearly perpendicular to each other. This means that the magnetic field generated by the AC current transported by the conductors in the cores is parallel or nearly parallel to the armour wires. This cause the eddy currents induced into the armour wires to be perpendicular or nearly perpendicular with respect to the armour wires longitudinal axis.

In the light of the above observations, the Applicant found that it is possible to further reduce the armour losses in an AC cable by using an armour winding pitch B unilay to the core stranding pitch A, with 0.4 A≤B≤2.5 A. In particular, the Applicant found that, by using an armour winding pitch B unilay to the core stranding pitch A, with 0.4 A≤B≤2.5 A, the ratio $\lambda_{2'}$ of losses in the armour to total losses in all conductors in the electric power cable is much smaller than the value $\lambda_2$ as computed according to the above mentioned formula (2) of IEC Standard 60287-1-1.

Taking into account the above formula (1) provided by IEC 60287-1-1, the unilay configuration of armour wires and cores enables to increase the permissible current rating of a cable. As stated above, the rise of permissible current rating leads to two improvements in an AC transport system: increasing the current transported by a cable and/or providing a cable with a reduced cross section area S, the increase/reduction being considered with respect to the case wherein the armour losses are instead computed according to formula (2) above mentioned.

It is noted that even if in the above description and figures cables comprising an armour with a single layer of wires have been described, the invention also applies to cables wherein the armour comprises a plurality of layers, radially superimposed.

In such cables, the multiple-layer armour preferably comprises a (inner) layer of wires with an armour winding lay and an armour winding pitch B, and an outer layer of wires, surrounding the (inner) layer, with an outer layer winding lay and an outer layer winding pitch B'.

As to the features of the (inner) layer, the armour winding lay, the armour winding pitch B, the core stranding lay and the core stranding pitch A, the same considerations made above with reference to an armour with a single layer of wires apply.

In particular, the wires of the (inner) layer have an elongated cross section with a major axis oriented tangentially with respect to the cable 10. In addition, the armour winding lay of the (inner) layer is preferably unilay to the core stranding lay.

As to the outer layer, the outer layer winding lay is preferably contralay with respect to the core stranding lay (and to the armour winding lay). This advantageously improves the mechanical performances of the cable.

As explained in detail above, when the armour winding lay of the (inner) layer of wires is unilay to the core stranding lay, the losses in the armour are highly reduced as well as the magnetic field (as generated by the AC current transported by the cable conductors) outside the (inner) layer of the armour, which is shielded by the inner layer. In this way, the outer layer, surrounding the (inner) layer, experiences a reduced magnetic field and generates lower armour losses, even if used in a contralay configuration with respect to the core stranding lay.

For cables comprising multiple-layer armour, the same considerations made above with reference to the ratio $\lambda_2$, (losses in the armour to total losses in all conductors in the electric cable) apply, wherein the losses in the armour are computed as the losses in the (inner) layer and the outer layer.

The invention claimed is:

1. A method of transporting an alternate current at a maximum allowable working conductor temperature using an alternate current power cable comprising at least one core, wherein each core comprises an electric conductor having a cross section area and an armour surrounding said core along a circumference, said cable having overall cable losses comprising conductor losses and armour losses, the method comprising:

selecting an armour with armour losses not higher than 10% of the overall cable losses, wherein said armour is made with a layer of a plurality of metal wires having an elongated cross section with a major axis, said major axis being oriented tangentially with respect to the circumference, wherein the layer of the plurality of metal wires includes one or more wires made of a ferromagnetic material, wherein one or more non-ferromagnetic wires are mixed with the one or more wires made of ferromagnetic material in a circumferential direction along the armour's entire length;

modifying a permissible current rating to an increased value, the increased value being determined by the value of the armour losses being not higher than 10% of the overall cable losses; and transporting at said maximum allowable working conductor temperature in the electric conductor, the alternate current at the increased value of the permissible current rating.

2. The method according to claim 1, wherein the elongated cross section of the plurality of metal wires of said armour has a ratio between a major axis length and minor axis length at least equal to 1.5.

3. The method according to claim 1, wherein the elongated cross section of the plurality of metal wires of said armour has a ratio between a major axis length and minor axis length not higher than 5.

4. The method according to claim 1, wherein the elongated cross section of the plurality of metal wires of said armour has smoothed edges.

5. The method according to claim 1, wherein the elongated cross section of the plurality of metal wires of said armour has a minor axis from 1 mm to 7 mm long.

6. The method according to claim 1, wherein the elongated cross section of the plurality of metal wires of said armour has a major axis from 3 mm to 20 mm long.

7. The method according to claim 1, wherein the alternate current power cable comprises more than one core, and reducing armour losses to a value not higher than 10% of the overall cable losses comprises:

stranding together the cores according to a core stranding lay and a core stranding pitch A; and winding the plurality of metal wires around the cores according to a helical armour winding lay and an armour winding pitch B, wherein the helical armour winding lay has a same direction as the core stranding lay, and the armour winding pitch B is from 0.4 A to 2.5 A and differs from A by at least 10%.

8. An alternate current power cable comprising:

at least one core comprising an electric conductor; and an armour surrounding the at least one core along a circumference, in which each electric conductor has a cross section area sized for operating the cable to transport said alternate current at a maximum allowable working conductor temperature, as determined by overall cable losses including armour losses, wherein:

the armour comprises a layer of a plurality of metal wires with an elongated cross section with a major axis, said plurality of metal wires being arranged with the major axis oriented tangentially with respect to the circumference, whereby the armour losses are reduced to a value not higher than 10% of the overall cable losses, wherein the layer of the plurality of metal wires includes one or more wires comprising a ferromagnetic material, wherein one or more non-ferromagnetic wires are mixed with the one or more wires made of ferromagnetic material in a circumferential direction along the armour's entire length; and further wherein:

the electric conductor has a cross section area sized with a reduced value as determined by reckoning the value of the reduced armour losses not higher than 10% of the overall cable losses; and/or the alternate current, to be transported in the electric conductor at the maximum allowable working conductor temperature, is sized with an increased value as determined by reckoning the value of the reduced armour losses not higher than 10% of the overall cable losses.

9. The power cable according to claim 8, wherein the elongated cross section of the plurality of metal wires has a ratio between a major axis length and a minor axis length at least equal to 1.5.

10. The power cable according to claim 8, wherein the elongated cross section of the plurality of metal wires has a ratio between a major axis length and a minor axis length not higher than 5.

11. The power cable according to claim 8, wherein the elongated cross section of the plurality of metal wires has smoothed edges.

12. The power cable according to claim 8, wherein the elongated cross section of the plurality of metal wires has a minor axis from 1 mm to 7 mm long.

13. The power cable according to claim 8, wherein the elongated cross section of the plurality of metal wires has a major axis from 3 mm to 20 mm long.

14. The power cable according to claim 8, comprising at least two cores stranded together according to a core stranding lay and a core stranding pitch A, wherein the plurality of metal wires is wound around the at least two cores according to a helical armour winding lay and an armour winding pitch B, wherein the helical armour winding lay has a same direction as the core stranding lay, and the armour winding pitch B is from 0.4 A to 2.5 A and differs from A by at least 10%.

15. A method of transporting an alternate current at a maximum allowable working conductor temperature using an alternate current power cable comprising at least one core, wherein each core comprises an electric conductor having a cross section area and an armour surrounding said core along a circumference and the cable having overall cable losses comprising conductor losses and armour losses, the method comprising:

selecting an armour with armour losses not higher than 10% of the overall cable losses, wherein the armour is made with a layer of a plurality of metal wires having an elongated cross section with a major axis, the major axis being oriented tangentially with respect to the circumference, wherein the layer of the plurality of metal wires includes one or more wires made of a ferromagnetic material, wherein one or more non-ferromagnetic wires are mixed with the one or more wires made of ferromagnetic material in a circumferential direction along the armour's entire length;

sizing the electric conductor with a reduced conductor cross section area determined by the value of the armour losses being not higher than 10% of the overall cable losses; and transporting, at the maximum allowable working conductor temperature in the electric conductor, the alternate current.

16. A method of transporting an alternate current at a maximum allowable working conductor temperature using an alternate current power cable comprising at least one core, wherein each core comprises an electric conductor having a cross section area and an armour surrounding said core along a circumference, said cable having overall cable losses comprising conductor losses and armour losses, the method comprising:

selecting an armour with armour losses not higher than 10% of the overall cable losses, wherein said armour is made with a layer of a plurality of metal wires having an elongated cross section with a major axis, said major axis being oriented tangentially with respect to the circumference, wherein the layer of the plurality of metal wires is made of a ferromagnetic material along the armour's entire length;

modifying a permissible current rating to an increased value, the increased value being determined by the value of the armour losses being not higher than 10% of the overall cable losses; and transporting at said maximum allowable working conductor temperature in the electric conductor, the alternate current at the increased value of the permissible current rating.

17. The method according to claim 16, wherein the elongated cross section of the plurality of metal wires of said armour has a ratio between a major axis length and minor axis length at least equal to 1.5.

18. The method according to claim 16, wherein the elongated cross section of the plurality of metal wires of said armour has a ratio between a major axis length and minor axis length not higher than 5.

19. The method according to claim 16, wherein the elongated cross section of the plurality of metal wires of said armour has smoothed edges.

20. The method according to claim 16, wherein the elongated cross section of the plurality of metal wires of said armour has a minor axis from 1 mm to 7 mm long.

21. The method according to claim 16, wherein the elongated cross section of the plurality of metal wires of said armour has a major axis from 3 mm to 20 mm long.

22. The method according to claim 16, wherein the alternate current power cable comprises more than one core, and reducing armour losses to a value not higher than 10% of the overall cable losses comprises:

stranding together the cores according to a core stranding lay and a core stranding pitch A; and winding the plurality of metal wires around the cores according to a helical armour winding lay and an armour winding pitch B, wherein the helical armour winding lay has a same direction as the core stranding lay, and the armour winding pitch B is from 0.4 A to 2.5 A and differs from A by at least 10%.

23. An alternate current power cable comprising:

at least one core comprising an electric conductor; and an armour surrounding the at least one core along a circumference, in which each electric conductor has a cross section area sized for operating the cable to transport said alternate current at a maximum allowable working conductor temperature, as determined by overall cable losses including armour losses, wherein:

the armour comprises a layer of a plurality of metal wires with an elongated cross section with a major axis, said plurality of metal wires being arranged with the major axis oriented tangentially with respect to the circumference, whereby the armour losses are reduced to a value not higher than 10% of the overall cable losses, wherein the layer of the plurality of metal wires is made of a ferromagnetic material along the armour's entire length; and further wherein:

the electric conductor has a cross section area sized with a reduced value as determined by reckoning the value of the reduced armour losses not higher than 10% of the overall cable losses; and/or the alternate current, to be transported in the electric conductor at the maximum allowable working conductor temperature, is sized with an increased value as determined by reckoning the value of the reduced armour losses not higher than 10% of the overall cable losses.

24. The power cable according to claim 23, wherein the elongated cross section of the plurality of metal wires has a ratio between a major axis length and a minor axis length at least equal to 1.5.

25. The power cable according to claim 23, wherein the elongated cross section of the plurality of metal wires has a ratio between a major axis length and a minor axis length not higher than 5.

26. The power cable according to claim 23, wherein the elongated cross section of the plurality of metal wires has smoothed edges.

27. The power cable according to claim 23, wherein the elongated cross section of the plurality of metal wires has a minor axis from 1 mm to 7 mm long.

28. The power cable according to claim 23, wherein the elongated cross section of the plurality of metal wires has a major axis from 3 mm to 20 mm long.

29. The power cable according to claim 23, comprising at least two cores stranded together according to a core stranding lay and a core stranding pitch A, wherein the plurality of metal wires is wound around the at least two cores according to a helical armour winding lay and an armour winding pitch B, wherein the helical armour winding lay has a same direction as the core stranding lay, and the armour winding pitch B is from 0.4 A to 2.5 A and differs from A by at least 10%.

30. A method of transporting an alternate current at a maximum allowable working conductor temperature using an alternate current power cable comprising at least one core, wherein each core comprises an electric conductor having a cross section area and an armour surrounding said core along a circumference and the cable having overall cable losses comprising conductor losses and armour losses, the method comprising:

selecting an armour with armour losses not higher than 10% of the overall cable losses, wherein the armour is made with a layer of a plurality of metal wires having an elongated cross section with a major axis, the major axis being oriented tangentially with respect to the circumference, wherein the layer of the plurality of metal wires is made of a ferromagnetic material along the armour's entire length;

sizing the electric conductor with a reduced conductor cross section area determined by the value of the armour losses being not higher than 10% of the overall cable losses; and transporting, at the maximum allowable working conductor temperature in the electric conductor, the alternate current.

* * * * *